US007497346B2

(12) United States Patent
Albers

(10) Patent No.: US 7,497,346 B2
(45) Date of Patent: Mar. 3, 2009

(54) SINGLE-USE CLOSURE SYSTEM FOR CONTAINERS

(75) Inventor: Martin Albers, Sundern (DE)

(73) Assignee: Gerogemenshen GmbH & Co. KG, Finnentrop (DE)

( * ) Notice: Subject to any disclaimer, the term of this patent is extended or adjusted under 35 U.S.C. 154(b) by 605 days.

(21) Appl. No.: 10/532,559

(22) PCT Filed: Oct. 14, 2003

(86) PCT No.: PCT/EP03/11387

§ 371 (c)(1),
(2), (4) Date: Apr. 22, 2005

(87) PCT Pub. No.: WO2004/037669

PCT Pub. Date: May 6, 2004

(65) Prior Publication Data

US 2005/0252876 A1 Nov. 17, 2005

(30) Foreign Application Priority Data

Oct. 21, 2002 (DE) ..... 20216175

(51) Int. Cl.
*B65D 41/48* (2006.01)
*B65D 55/08* (2006.01)
*B65D 50/00* (2006.01)

(52) U.S. Cl. ..... 215/354; 215/256; 215/353; 215/225; 215/901

(58) Field of Classification Search ..... 215/354, 215/47, 252, 256, 330, 901, 353, 317, 254
See application file for complete search history.

(56) References Cited

U.S. PATENT DOCUMENTS 3,716,162 A * 2/1973 Botkin ..... 215/316
3,841,512 A * 10/1974 Botkin ..... 215/365
3,858,748 A * 1/1975 Marco ..... 220/276

(Continued)

*Primary Examiner*—Anthony D Stashick
*Assistant Examiner*—Niki M Eloshway
(74) *Attorney, Agent, or Firm*—Andrew Wilford

(57) ABSTRACT

The invention relates to a closure system for containers comprising a threaded plug (1) and the neck (3) of the container (2) or the similar embodied in the form of an pouring aperture (5), the threaded plug being screwed on the neck in such a way that said pouring aperture is closed. The inventive closure system for containers is characterised in that it is embodied in the form a single-use closure system which comprises an extensible flange (15) arranged at the level of the threaded plug in the back clamping area of the flange (7) of the neck (3) embodied for this purpose. The external radial size of said extensible flange is greater than the radial dimension of a hole defining the back clamping area of the flange. The extensible flange can, for example be engaged in the pouring aperture (5) of the neck (3), and the back clamping zone (7) can be provided in a pouring passage (4) in a neck part. The extensible flange can be removed through the defining hole by an elastic reset force radially exerted at least by the extensible flange or the back clamping area thereof, thereby being prevented from returning to the back clamping area.

8 Claims, 1 Drawing Sheet

U.S. PATENT DOCUMENTS 4,024,976 A * 5/1977 Acton ..... 215/50
4,190,175 A * 2/1980 Allen ..... 220/270
4,251,002 A * 2/1981 Middleton et al. ..... 215/253
4,296,871 A * 10/1981 Andersson ..... 220/781
4,520,943 A * 6/1985 Nielsen ..... 220/281
4,527,702 A * 7/1985 Heath, Jr. ..... 215/225
4,555,042 A * 11/1985 Rathbun ..... 220/277
4,690,291 A * 9/1987 Grant ..... 215/47
4,711,364 A * 12/1987 Letica ..... 220/276
4,878,595 A * 11/1989 Uhlig ..... 220/783
5,027,969 A * 7/1991 Lesquir ..... 220/270
5,170,905 A * 12/1992 Luch ..... 220/276
5,249,694 A * 10/1993 Nelson ..... 220/276
5,307,948 A * 5/1994 Blackburn et al. ..... 220/269
5,398,836 A * 3/1995 Luch et al. ..... 220/276
5,540,342 A * 7/1996 Rathbun ..... 215/225
5,785,203 A * 7/1998 Arshinoff et al. ..... 220/783
5,931,332 A * 8/1999 Mygatt et al. ..... 220/270
5,960,979 A * 10/1999 Van Den Brink et al. .... 220/266
RE36,729 E * 6/2000 Luch et al. ..... 220/276

* cited by examiner

SINGLE-USE CLOSURE SYSTEM FOR CONTAINERS

CROSS REFERENCE TO RELATED APPLICATIONS

This application is the US national phase of PCT application PCT/EP2003/011387, filed 14 Oct. 2003, published 6 May 2004 as WO 2004/037669, and claiming the priority of German patent application 20216175.7 itself filed 21 Oct. 2002.

The invention relates to a container closure assembly comprising a cap part and neck part defining an outlet mouth for container.

The invention relates in particular to a single-use assembly. Such a single-use assembly is used to close containers for products that should be used immediately once they are opened because they spoil readily, e.g. become toxic, when exposed to air. It is necessary that once the container is open, it cannot be closed again with the same closure. Such a closure with this effect is seen in the known crown cap. They require however that a tool be used to open them, and the container must be robust. Closing the outlet opening of containers formed as bags is not possible with this assembly. In addition in spite of the inability to reuse the closure, for esthetic reasons it should look like a standard screw or snap cap.

In response to this need, the invention proposes a closure assembly that is characterized by the features of claim 1. In particular a spreadable collar on the cap part is fittable with a collar-engaging region of the neck part and has a radial outer dimension that is smaller as the radial dimension of the edge of the collar-engaging region. The spreadable collar can move outward past the edge with elastic deformation of the spreadable collar or of the collar-engaging region but inward movement is inhibited by the collar-engaging region. From the outside, the single-use closure according to the invention in spite of the described function in not distinguishable from standard container closures. The single-use closure can be constructed such that once the cap part is removed it cannot be fitted back over the neck part. Such a construction is also possible in that the cap part cannot after being removed be fitted back to the closed position on the neck part, but can only assume an intermediate position in which it does not block the outlet mouth. This facilitates at least the recycling of containers with the single-use closure according to the invention after they have been emptied.

The invention is more closely described in the following with reference to embodiments and the drawing. Therein:

Figure 1:
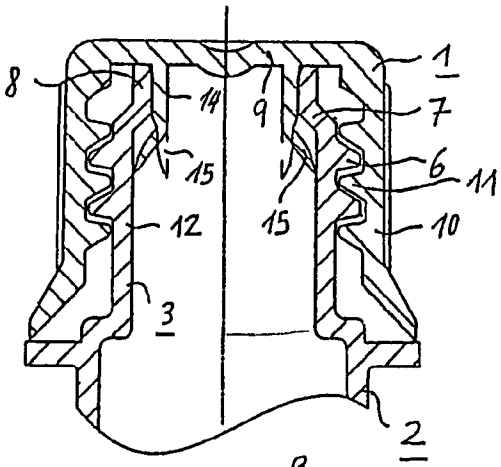
FIG. 1 is a longitudinal section through a single-use closure assembly with part of the container in a starting position according to an embodiment of the invention.

The invention is described in the following with reference to embodiments wherein a cap part 1 is mounted on a neck part 3 of a container 2, the neck part 3 and cap part 1 having complementary interfitting screwthreads so that the cap part 1 can expose an outlet mouth 5 by being screwed off. It is understood that the invention is not limited to such mounting of the cap part 1, but the cap part 1 can also be removable in another manner. e.g. by an axial straight-line movement from the neck part 3.

In the following reference is made to the embodiment of the invention shown in FIGS. 1 and 1A. The neck part 3 defines an the outlet passage 4 with a large-diameter portion 12 near the container 2 and a small-diameter portion 8 near its mouth 5. Between the portions 8 and 12 there is a conical transition region 7 that forms a frustoconical annular engagement surface 13 that tapers toward the small-diameter portion 8.

The cap part 1 has as is known a cap end wall 9 and a rim 10 projecting from its outer periphery. The cap part 1 fits over the neck part 3 and an internal screwthread 11 inside the rim 10 fits with a complementary external screwthread 6 on the neck part 3 so as to allow the cap part 1 to seal the mouth 5 of the neck part 3.

Figure 1A:
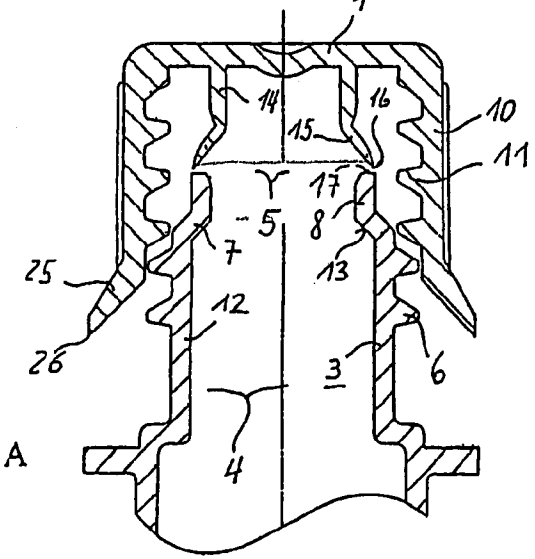
FIG. 1A is the single-use assembly according to FIG. 1 after separation of the cap part from the neck part.

An annular flange 14 projects inward from the cap end wall 9 and has an outer diameter that corresponds to an inner diameter of the small-diameter portion 8 of the neck part 3 so that the annular flange 14 can fit inside the small-diameter portion 8 of the neck part 3 as shown in FIG. 1.

The outer end of the annular flange 14 is provided with a spreadable collar 15 that flares outward and downward from the annular flange 14 and that has a sharp edge 16 whose diameter corresponds generally to that of the large-diameter portion 12 of the neck part 3 or is slightly greater or slightly smaller than this diameter. The spreadable collar 15 has a conical or slightly rounded and curved upper face that engages against the engagement surface 13 of the transition region 7 on removal of the cap part 1 from the neck part 3. This causes an elastic deformation of the spreadable collar 15 so as to reduce its diameter so that it can be pulled through the small-diameter region 8. As soon as the spreadable collar 15 passes the mouth 5, it returns elastically to its initial spread condition as shown in FIG. 1A.

In the spread condition, the edge 16 of the spreadable collar 15 is bigger than the mouth 5 so that, if an attempt is made to screw or fit the cap part 1 again on the neck part 15, the edge 16 of the spreadable collar 15 will engage an outer edge 17 of the neck part 3 and thereby prevent the cap part 1 from moving axially further along the neck part 3. Even if a substantial axial force is exerted in the assembly direction, it is impossible to fit the cap part 1 and neck part 3 back together as shown in FIG. 1 since such pushing will only further spread or enlarge the radial dimension of the spreadable collar 15.

As shown in FIG. 1 at 15', during initial mounting of the cap part 1 on the neck part 3 the spreadable collar 1 can be oriented axially or can form an axial extension of the flange 14. An unillustrated tool fitted with the neck part 3 can, for example by cold or hot plastic deformation, impart to the spreadable collar 15 the final shape shown in solid lines. This type of mounting is advantageous when the single-use assembly is used with molded parts for bag-like containers.

Figure 2:
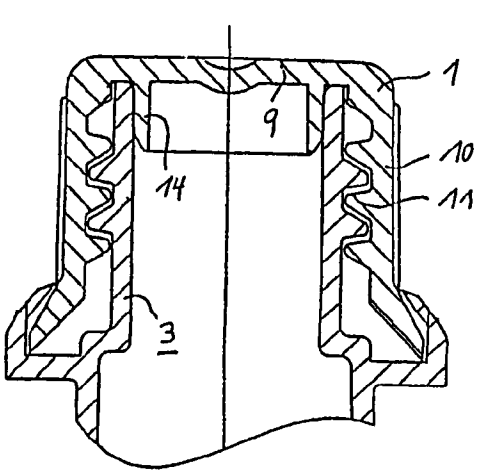
FIG. 2 is a view like FIG. 1 of a single-use closure assembly according to a further embodiment of the invention.
Figure 2A:
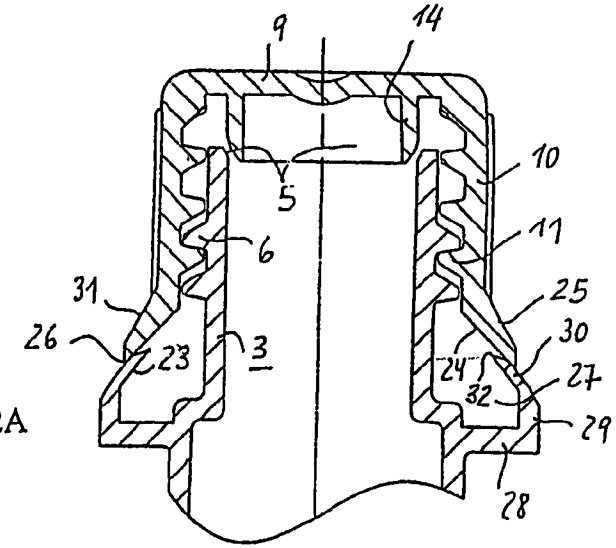
FIG. 2A is the single-use assembly according to FIG. 2 after separation of the cap part from the neck part.

FIGS. 2 and 2A show a further embodiment of the invention. The same or similar parts are assigned the same references as in the embodiment of FIGS. 1 and 1A and are not described again below. In the embodiment of FIGS. 2 and 2A the means that prevent fitting the cap part 1 back on in the FIG. 2 starting or closed position, once the cap part 1 has been removed from the neck part 3, are provided outside the cap part 1 and neck part 3. More particularly, the lower end of the cap rim 10 is provided with a spreadable collar 25 that flares outward and downward from the cap rim 10 and that has a sharp outer edge 26, a frustoconical outer face 24, and a conical inner face 31.

The neck part 1 is provided with an annular recess or seat 27 in which fits the spreadable collar 25 in the closed position of the cap part 1 as shown in FIG. 2. The seat 27 can be formed by a web 28 projecting radially outward from the neck part and having at its outer end an axially upwardly projecting rim 29. An extension 30 projects upward and inward from the upper edge of the rim 29 to an edge 32. The edge 32 defines an outer edge of the seat 27 and has a radial dimension that is smaller than that of the edge 26 of the spreadable collar 25 so that, on removal of the cap part 1 from the neck part 3, the spreadable collar 25 is forced through the edge 32, either by reducing the diameter of the edge 26 or increasing the diameter of the edge 32. This is possible due to the elasticity of the spreadable collar 25 or of the frustoconical extension 30 or of both parts, but the parts return elastically to their FIG. 2 starting position as soon as the spreadable collar 25 has moved into or out of the seat 27.

As shown in FIG. 2A, the edge 26 of the spreadable collar 25 overhangs the extension 30 when the cap part 1 has been moved through a predetermined axial distance into the position unblocking the mouth 5. An attempt to put the cap part 1 back into the closed position causes the inner face 24 of the spreadable collar 25 to engage the outer face of the extension 30, thereby increasing the diameter of the edge 26 and not permitting the spreadable collar 25 to fit back into the seat 27.

During initial installation, as in the above-described embodiment of the invention, the extension 30 extends mainly axially and an unillustrated tool for example hot or cold plastically deforms it into the shape shown in the drawing with the spreadable collar 25 in the seat 27.

With both embodiments of the invention the cap part and the neck part can be made in one shot by two-component injection molding in that one part is formed in an injection mold and the same mold is then used to make the other part. The two-component injection molding of plastics is known in the art and does not need to be more closely described here. In this manner the complementary shapes are achieved as shown in FIGS. 1 and 2 without having to employ a separate second deformation step.

The spreadable collar can be formed as annularly continuous or of segments. Instead, a reduction of the spreadable collar and/or of the part fitting with it can be provided in diametrally opposite regions of the cap part or neck part.

The invention claimed is:

1. A closure assembly for a container, the assembly comprising:

a neck part extending along an axis and defining an axially outwardly open outlet mouth;

a cap part fittable in a closed position with the neck part to block the outlet mouth;

interengaging means on the parts for retaining the cap part in the closed position and actuatable for axial outward movement of the cap part relative to the neck part into an open position unblocking the outlet mouth;

an annular collar formation formed on one of the parts, flared axially inward, and having an outer edge of a predetermined large diameter; and an annular formation on the other of the parts having a flared surface flared axially inward and having an inner edge of a predetermined small diameter smaller than the large outer-edge diameter, the inner edge being axially outward of the collar outer edge in the closed position, at least one of the formations being elastically radially deformable on outward movement of the cap part from the closed position to the open position with the outer edge passing the inner edge, the formations engaging axially and preventing the cap part from moving from the open position to the closed position.

2. The closure assembly defined in claim 1 wherein the collar formation is formed on the cap part and fits radially inside the neck part in the closed position.

3. The closure assembly defined in claim 2 wherein the neck part has a large-diameter portion, a small-diameter portion between the large-diameter portion and the outlet mouth, and an transition region between the large- and small-diameter portions and having an inner surface forming the flared surface of the other part.

4. The closure assembly defined in claim 1 wherein the cap part has a rim fitting over and around the neck part and formed with the collar formation, the annular formation of the other part being an annular frustoconical wall tapering axially outward and annular surrounding the collar formation.

5. The closure assembly defined in claim 1 wherein the collar formation has an sharp edge.

6. The closure assembly defined in claim 1 wherein the collar formation is annularly continuous.

7. The closure assembly defined in claim 1 wherein both the neck and cap part are made of plastic.

8. The closure assembly defined in claim 1 wherein the means are interengaging screwthreads formed on the parts.

* * * * *

UNITED STATES PATENT AND TRADEMARK OFFICE

CERTIFICATE OF CORRECTION

PATENT NO. : 7,497,346 B2
APPLICATION NO. : 10/532559
DATED : March 3, 2009
INVENTOR(S) : Martin Albers It is certified that error appears in the above-identified patent and that said Letters Patent is hereby corrected as shown below:

On the Title Page, Item (73)

The correct name of the Assignee should read as:

-- GEORG MENSHEN GMBH & CO. KG --

Signed and Sealed this

Twenty-eighth Day of April, 2009

JOHN DOLL
*Acting Director of the United States Patent and Trademark Office*